United States Patent [19]

Dillon, Jr. et al.

[11] 3,990,760

[45] Nov. 9, 1976

[54] ELECTRICAL CONNECTOR FOR WIRE LEADS

[75] Inventors: Clifford Francis Dillon, Jr., Albion; John Peter West, Attica, both of N.Y.

[73] Assignee: GTE Sylvania Incorporated, Stamford, Conn.

[22] Filed: Aug. 22, 1975

[21] Appl. No.: 607,011

[52] U.S. Cl. ..... 339/74 R; 339/260

[51] Int. Cl.[2] ..... H01R 13/62

[58] Field of Search ..... 339/74 R, 75 R, 89 R, 339/260, 261, 274, 41, 253 R, 253 S, 74 L, 262 RR, 273 R, 273 S

[56] References Cited

UNITED STATES PATENTS

| | | | |
|---|---|---|---|
| 2,696,535 | 12/1954 | McLean et al. | 339/253 S X |
| 2,856,592 | 10/1958 | Carlson | 339/274 X |
| 3,518,614 | 6/1970 | Nyberg | 339/74 L |

*Primary Examiner*—Roy Lake
*Assistant Examiner*—E. F. Desmond
*Attorney, Agent, or Firm*—Norman J. O'Malley; Thomas H. Buffton; Robert T. Orner

[57] ABSTRACT

An electrical connector for wire leads includes a housing member affixed to and extending outwardly from one surface of a mounting board with a pair of contact members affixed to the housing member and extending outwardly from the opposite surface of the mounting board and a rotatable activating member telescoped over the contact members, rotatably contacting the mounting board and the contact members, and having an aperture therein aligned with the contact members.

11 Claims, 4 Drawing Figures

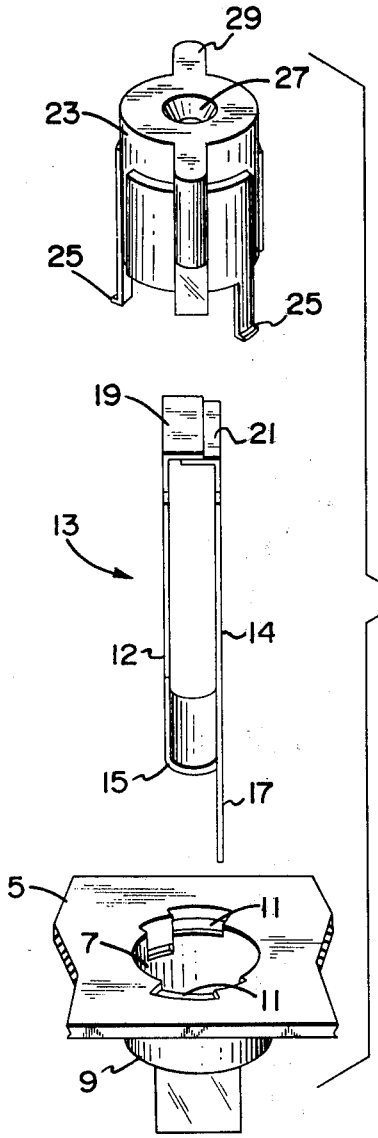
Fig. 1
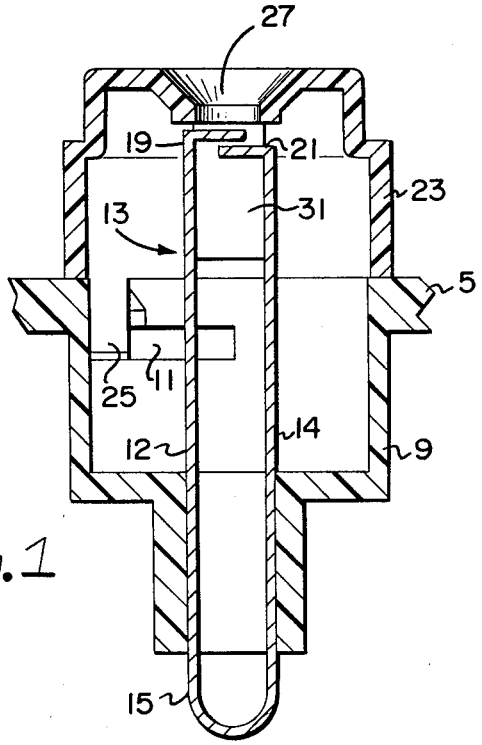
Fig. 2
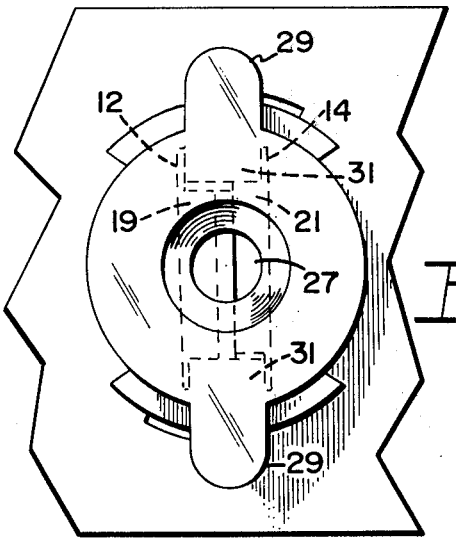
Fig. 3
Fig. 4
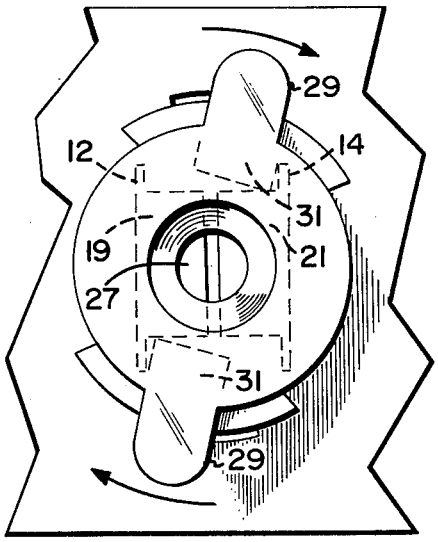

ELECTRICAL CONNECTOR FOR WIRE LEADS

BACKGROUND OF THE INVENTION

This invention relates to electrical connectors and more particularly to electrical connectors for lead wires such as antenna lead in wires and loudspeaker connections for example.

Some years ago it was found advantageous for an operator or listener to be able to connect and disconnect lead wires without the use of any tools. For example, connecting and disconnecting stereo speakers and antenna leads without tools is especially convenient for a customer and connectors permitting this have been commercially available for some time.

Generally, one well-known type of connector for lead wires includes a stationary contact member which is crimped to a mounting board. The stationary contact has a hole therein and a movable contact member is disposed therein with a compression spring intermediate the stationary and movable contact members. Thus, pressure is applied to the movable contact member in an amount sufficient to distort the compression spring. Thereupon an opening aligned with the hole in the stationary contact is provided for lead wire insertion. Removal of the pressure on the movable contact member releases the compression spring and the stationary and movable contact members are forced against the lead wire.

In another known form of connector for lead wires, a stationary contact member has an aperture and is affixed to a board member by a screw. A levered movable contact member is pivoted in the stationary contact member with a compression spring disposed intermediate the stationary and movable contact members. Moreover, the movable contact member has an opening at one end. Pressure on the levered movable member depresses the compression spring and aligns the opening at the end of the movable contact member with the aperture of the stationary member. Thus, a lead wire may be entered into the aperture and opening with the stationary and movable contacts being forced against the lead member upon removal of the pressure from the movable contact member.

Although the above-mentioned connectors for wire leads do provide a connect and disconnect capability without the use of tools and have been and still are employed in many forms of apparatus, it has been found that each leaves something to be desired. For example, both of the above-mentioned types of electrical connectors require a "push" force to open and permit entry of a lead wire. However, a "push" force tends to undesirably induce tipping or sliding of the apparatus in many instances which would be deleterious to stereo and TV receivers for example. Moreover, types which are crimped to a mounting board often become loosened while levered systems usually have excessive parts which greatly increase the cost.

OBJECTS AND SUMMARY OF THE INVENTION

An object of the present invention is to provide an enhanced electrical connector for lead wires. Another object of the invention is to provide an electrical connector for lead wires which responds to force in a direction which does not cause tipping and sliding of the apparatus. Still another object of the invention is to provide an electrical connector for lead wires which is inexpensive of component parts and assembly labor. A further object of the invention is to provide an electrical connector for rapid connection and disconnection of lead wires in response to the administration of a rotational force.

These and other objects, advantages and capabilities are achieved in one aspect of the invention by an electrical connector having a housing member affixed to and extending from one surface of a mounting board, an electrical contact member affixed to the housing member and extending outwardly from the opposite surface of the mounting board, and a rotatable activating member telescoped over the outwardly extending contact member with an aperture therein and formed for rotation to cause activation of the electrical contact member for effecting connection and disconnection of a lead wire.

BRIEF DESCRIPTION OF THE DRAWINGS

FIG. 1 is an exploded isometric view of the preferred embodiment of the invention;

FIG. 2 is a cross-sectional illustration of the embodiment of FIG. 1; and FIGS. 3 and 4 are operational illustrations of the preferred embodiment of FIG. 1.

DESCRIPTION OF THE PREFERRED EMBODIMENT

For a better understanding of the present invention, together with other and further objects, advantages and capabilities thereof, reference is made to the following disclosure and appended claims in conjunction with the accompanying drawings.

Referring to FIG. 1 of the drawings, a mounting board 5 has a hole 7 therein with housing member 9 integral to or affixed to the mounting board 5. A pair of elongated slots 11 are located intermediate the mounting board 5 and the housing member 9.

An electrical contact member 13, preferably in the form of a single piece of electrically conductive material, includes a pair of contact members 12 and 14. The electrical contact member 13 has an arc-like bend 15 at one end with an electrical connecting member 17 extending outwardly therefrom. The opposite end of the electrical contact member 13 has a pair of overlapping portions 19 and 21 formed to provide electrical connection to a lead in wire.

A rotatable member 23 is formed to telescope over the electrical contact member 13. The rotatable member 23 includes a pair of holding members 25 formed for insertion and rotational movement within the elongated slots 11 intermediate the mounting board 5 and the housing member 9. An aperture 27 for wire lead introduction is centrally located and a pair of diametrically opposed ear members 29 extend outwardly from the rotatable member 23. Moreover, the rotatable member 23 includes a pair of contact activating members 31 (not shown in FIG. 1) which are aligned with the diametrically opposed ear members 29 and extend inwardly therefrom intermediate the electrical contact member 13.

Referring to the cross-sectional view of FIG. 2, the mounting board 5 and the housing member 9 are, in this instance, an integral unit with the elongated slot 11 formed therebetween. The electrical contact member 13 is affixed to the housing member 9 with the arc-like bend 15 at one end extending outwardly from one surface of the mounting board and the overlapping portions 19 and 21 extending outwardly from the opposite surface of the mounting board 5.

The holding members 25 of the rotatable member 23 are disposed within the elongated slots 11 whereby the rotatable member 23 is movably affixed to the mounting board 5. The central aperture 27 of the rotatable member 23 is aligned with the overlapping portions 19 and 21 of the electrical contact member 13 and the diametrically oppositely disposed contact activating members 31 extend inwardly intermediate the contact members 12 and 14.

As can more clearly be seen in the operational views of FIGS. 3 and 4, the inactivated or "at rest" position is indicated in FIG. 3. Therein, the oppositely disposed ear members 29 have no pressure exerted thereon whereupon the oppositely disposed contact activating members 31 exert no activating pressure on the electrical contact members 12 and 14 of FIG. 2. Thus, the overlapping portions 19 and 21 remain in the normal overlap location and effectively inhibit the insertion of a lead wire through the central aperture 27 and intermediate thereto.

However, FIG. 4 illustrates the activated positional location whereat rotational pressure is exerted upon the outwardly extending ear member 29. Thereupon, the inwardly extending contact activating members 31 exert pressure on the contact members 12 and 14 whereupon the overlapping portions 19 and 21 are forced apart to provide an opening therebetween. Thus, a lead wire may be inserted through the aperture 27 and into the opening intermediate the overlapping portions 19 and 21 of the electrical contact members 12 and 14. When the rotational pressure is removed from the ear members 29, the overlapping portions 19 and 21 provide electrical connection of the electrical contact members 12 and 14 and a lead wire. Obviously, removal of the lead wire is effected by re-applying rotational pressure to the ear members 29.

Thus, there has been provided a unique electrical connector for lead wires which is easily connected and disconnected without the use of special tools. The connector is of simple construction and therefore inexpensive of labor and materials. Moreover, the simplicity of the structure enhances the durability and reliability of the apparatus which the rotational activating pressures do not tend to cause sliding or tipping of the structure.

While there has been shown and described what is at present considered the preferred embodiment of the invention, it will be obvious to those skilled in the art that various changes and modifications may be made therein without departing from the invention as defined by the appended claims.

What is claimed is:

1. An electrical connector for wire leads comprising:
- a mounting board;
- a housing member affixed to and extending outwardly from one surface of said mounting board;
- a pair of contact members disposed within said housing member and extending outwardly from the opposite surface of said mounting board; and
- a rotatable activating member extending outwardly from said mounting board in a direction opposite to said housing member and telescoped over said pair of contact members, said activating member including holding members movably affixed intermediate said mounting board and housing member, a contact activating member associated with said contact members, and an aperture for lead wire insertion aligned with said pair of contact members.

2. The electrical connector for wire leads of claim 1 wherein said housing member is integral to and formed from said mounting board.

3. The electrical connector for wire leads of claim 1 wherein said pair of contact members each include an overlapping portion formed for contact with a wire lead.

4. The electrical connector for wire leads of claim 1 wherein said rotatable activating member includes contact activating members diametrically oppositely disposed and intermediate said pair of contact members.

5. The electrical connector for wire leads of claim 1 wherein said housing member includes a pair of elongated slots intermediate thereto and said mounting board and said rotatable activating member includes holding members disposed within said elongated slots to permit rotational movement of said rotatable activating member.

6. The electrical connector for wire leads of claim 1 wherein said pair of contact members are formed from a single piece of electrically conductive material.

7. The electrical connector for wire leads of claim 1 wherein said pair of contact members are in overlapping relationship to said aperture, provide an opening therebetween in alignment with said aperture upon application of rotational pressure to said rotatable activating members, and automatically return to said overlapping relationship upon removal of said rotational pressure to said rotatable activating member.

8. An electrical connector for wire leads comprising:
- a mounting board;
- a pair of contact members;
- means for housing said pair of contact members affixed to and extending outwardly from one surface of said mounting board; and
- means for rotatably activating said pair of contact members, said means including a pair of activating members diametrically opposed and intermediate said pair of contact members and telescoped over and including an aperture formed therein and aligned with said pair of contact members.

9. The electrical connector for wire leads of claim 8 wherein said pair of contact members are in the form of a single piece of electrically conductive material.

10. The electrical connector for wire leads of claim 8 wherein said pair of contact members are ordinarily in overlapping relationship and responsive to rotational pressure to provide an opening therebetween for lead wire insertion with a tendency to return to said overlapping relationship upon release of said rotational pressure.

11. The electrical connector for wire leads of claim 8 wherein said means for housing a pair of contact members includes a pair of elongated slots intermediate thereto and said mounting board and said means for rotatably activating said contact members includes holding members disposed within said elongated slots.

* * * * *